United States Patent [19]

Stofko et al.

[11] 4,454,005

[45] Jun. 12, 1984

[54] METHOD OF INCREASING INTERFIBER BONDING AMONG FIBERS OF LIGNOCELLULOSIC MATERIAL, AND RESULTANT PRODUCT

[75] Inventors: Jan Stofko, St. Charles, Ill.; Eugene Zavarin, San Francisco, Calif.

[73] Assignee: The Regents of the University of California, Berkeley, Calif.

[21] Appl. No.: 60,964

[22] Filed: Jul. 26, 1979

Related U.S. Application Data

[63] Continuation-in-part of Ser. No. 13,279, Feb. 21, 1979, abandoned, which is a continuation of Ser. No. 566,996, Apr. 10, 1975, abandoned.

[51] Int. Cl.[3] ..... D21H 3/66

[52] U.S. Cl. ..... 162/12; 162/78; 162/79; 162/81; 162/181.2; 162/207

[58] Field of Search ..... 162/78, 79, 81, 12, 162/13, 136, 158, 207, 226, 150, 181.2

[56] References Cited

U.S. PATENT DOCUMENTS

| | | | |
|---|---|---|---|
| 1,758,920 | 5/1930 | Baum | 252/97 |
| 1,987,212 | 1/1935 | Richter | 162/78 |
| 2,125,634 | 8/1938 | Heritage | 162/78 |
| 2,150,926 | 3/1939 | Kauffmann et al. | 162/13 |
| 2,388,487 | 11/1945 | Linzell | 162/150 |
| 2,394,989 | 2/1946 | Dreyfus | 162/78 |
| 2,514,503 | 7/1950 | McEwen et al. | 162/78 |
| 2,859,087 | 11/1958 | Hawkinson et al. | 162/78 |
| 4,022,965 | 5/1977 | Goheen et al. | 162/78 |

*Primary Examiner*—William F. Smith

*Attorney, Agent, or Firm*—Edward B. Gregg

[57] ABSTRACT

Defiberized lignocellulosic material, such as wood, is treated with a liquid carrier containing an oxidizing agent (a per compound, a chlorate or a nitrate), and the wet mat thereof is subjected to pressure, and to heat for a sufficient period of time to cause an oxidative reaction among the fibers resulting in a strong interfiber bond. Where the oxidizing agent is a per compound, the pH of the mixture or lignocellulosic material and per compound is less than 7. Catalysts or other reaction modifying agents are employed if needed. By virtue of the enhanced interfiber bonding effect, paper sheets, such as liner board, which are usually formed of delignified cellulosic material, the fibers of which are highly refined, can be formed totally or partially of less expensive sources of material such as ground wood, semi-chemical or semi-mechanical lignocellulosic pulps without sacrifice of strength.

4 Claims, 1 Drawing Figure

METHOD OF INCREASING INTERFIBER BONDING AMONG FIBERS OF LIGNOCELLULOSIC MATERIAL, AND RESULTANT PRODUCT

This application is a continuation-in-part of Ser. No. 013,279, filed Feb. 21, 1979, now abandoned which is a continuation of Ser. No. 566,996, filed Apr. 10, 1975 now abandoned.

RELATED APPLICATION

The invention hereof is related to Applicants' copending application, Ser. No. 401,370, filed Sept. 27, 1973, entitled "METHOD OF BONDING SOLID LIGNOCELLULOSIC MATERIAL, AND RESULTING PRODUCT", now U.S. Pat. No. 4,007,312, dated Feb. 8, 1977, but is specific to defiberized lignocellulosic material for the manufacture of paper or paper like products in which enhanced interfiber bonding is effected in constradistinction to surface to surface interface bonding of solid wood.

BACKGROUND OF THE INVENTION

Bonding of lignocellulosic fiber materials, such as wood fiber, is widely used commercially as for example in the manufacture of paper or fiber products. In present commercial bonding procedures, bonding among the fibers is based primarily on physical forces created by the large surface of finely interlocked cellulose fibers. For increasing the bonding strength of such product, one may add to the pulp, before mat or sheet formation, sizing substances such as starch or resins as adhesives. Strength increase by such procedure is only moderate, and moreover the use thereof increases costs. Strength may also be increased by formation (fibrillation) of longer and more refined fibers. This involves, however, more complicated and costly chemical pulping procedures, and results in lower yield, of about 45% in the Kraft process, compared to 95% in mechanical pulping.

SUMMARY AND OBJECTS OF THE INVENTION

In the invention hereof, less expensive sources of lignocellulosic fibers are rendered available for the production of paper or paper like products, which provide physical properties comparable to more expensive fiber sources. Thus, high lignin content mechanical pulp (ground wood), semi-mechanical or semi-chemical pulp provide sources for the production of products of increased strength, such as liner board or other flexible paper, which could not normally be obtained otherwise. Such objective is achieved by increasing the interfiber bonding strength among the fibers, by thoroughly dispersing throughout a mat of the fibers, an oxidizing agent of a certain class which results in formation of interfiber chemical linkages effected by oxidation upon application of heat.

Ground wood, which is now widely employed as a source for newsprint or other high lignin content fibers, can by the invention hereof be employed for the manufacture of much stronger flexible sheets not heretofore obtainable from ground wood, such as liner board used in the manufacture of corrugated paper and cartons. Ground wood is mechanically ground in the presence of water, and is known as mechanical pulp. Substantially no lignin is removed by such mechanical treatment.

Although the invention hereof is particularly applicable to ground wood as it enables an inexpensive source of fiber to be used for paper products requiring strength properties not heretofore obtainable from ground wood, it may be employed with other sources of defiberized lignocellulosic material wherein at least some of the ligning is present such as semi-chemical and semi-mechanical pulps, which normally form weaker paper mats than fully delignified lignocellulosic material. In this connection, to obtain the oxidative bonding reaction, at least some lignin should remain in the defiberized material, or lignin like material, such as phenolics added thereto.

The chemical reactions involved in the process hereof are not fully understood. Wood is a high-polymeric substance composed of three classes of materials—carbohydrates (primarily cellulose), lignin and extractives. While cellulose is a polysaccharide built up of glucose units, lignin appears to be a polymeric phenolic material, the structure of which is still not fully understood. Not much is known about the bond between the carbohydrates and lignin, although, generally speaking, lignin seems to function as a binder for cellulose microfibrils. The function of extractives appears to be manifold; their disease protective function is probably the most important.

In oxidation of lignocellulosic materials several reaction systems may be involved at the same time. Based on the present day chemical knowledge, it can be assumed that the oxidation of phenolic units contained in lignin structure is either the main or at least one of the main reactions leading to self bonding of lignocellulosic materials. In this case the intermediate formation of free radicals is likely to take place, coupling under the formation of lignin-to-lignin linkages. It cannot be excluded, however, that to some extend polysaccharide-to-polysaccharide and lignin-to-polysaccharide bonding also takes place during this oxidation.

In effecting the oxidation reaction, a mat of the defiberized material is provided in which an oxidant is thoroughly dispersed uniformly therethrough. The mat is formed into a sheet under pressure and heat for a time sufficient to effect the oxidative reaction. In this connection, the oxidizing agent may also be employed with a promoter to promote the oxidative bonding.

The invention hereof may readily be performed on a paper making machine wherein a paper mat is formed in the conventional manner. The mat is then sprayed or roller coated with the oxidant in a liquid carrier which wets the mat, and with a catalyst to promote the reaction. They may both be contained in the same carrier or applied separately to the sheet in the machine as will be discussed more fully hereinafter.

From the preceding it is seen that the invention has as its objects, among others, the provision of an improved method of effecting increased interfiber bonding among fibers of defiberized lignocellulosic material by effecting an oxidative reaction among the fibers, which method is simple to perform and renders available less expensive sources of pulp for the manufacture of paper or paperboard sheets requiring strength, and which is economical and simple to perform.

Other objects will become apparent from the following more detailed description, and accompanying drawing, in which:

The single FIG. 1 is a schematic side elevational view of a conventional Fourdrinier paper making machine in which the invention hereof may be performed in various ways; parts being broken away to shorten the view.

PRIOR ART

The patent to Heritage U.S. Pat. No. 2,125,634, dated Aug. 2, 1938, discloses bleaching of paper pulp in a paper making machine by applying hydrogen peroxide to the wet or partially wet mat in minute concentrations in the presence of an alkali such as sodium silicate, at a point ahead of or in advance of the dry end of the dryer, solely to bleach the sheet or pulp. However, it has been found pursuant to this invention that hydrogen peroxide will effect the oxidative bonding reaction better if a catalyst is provided. It is believed that such catalyst (examples of which are given below) modifies the hydrogen peroxide by decomposing it under heat and pressure to free radicals instead of to oxygen and water. Transition metals and many other inorganic and organic substances can effect such peroxide decomposition. Moreover, the pH of the hydrogen peroxide solution should be below pH 7, and the concentration of the hydrogen peroxide in the carrier should be above 1% to be effective, and desirably above 5%, and may be as high as 50%.

DETAILED DESCRIPTION

Figure 1:
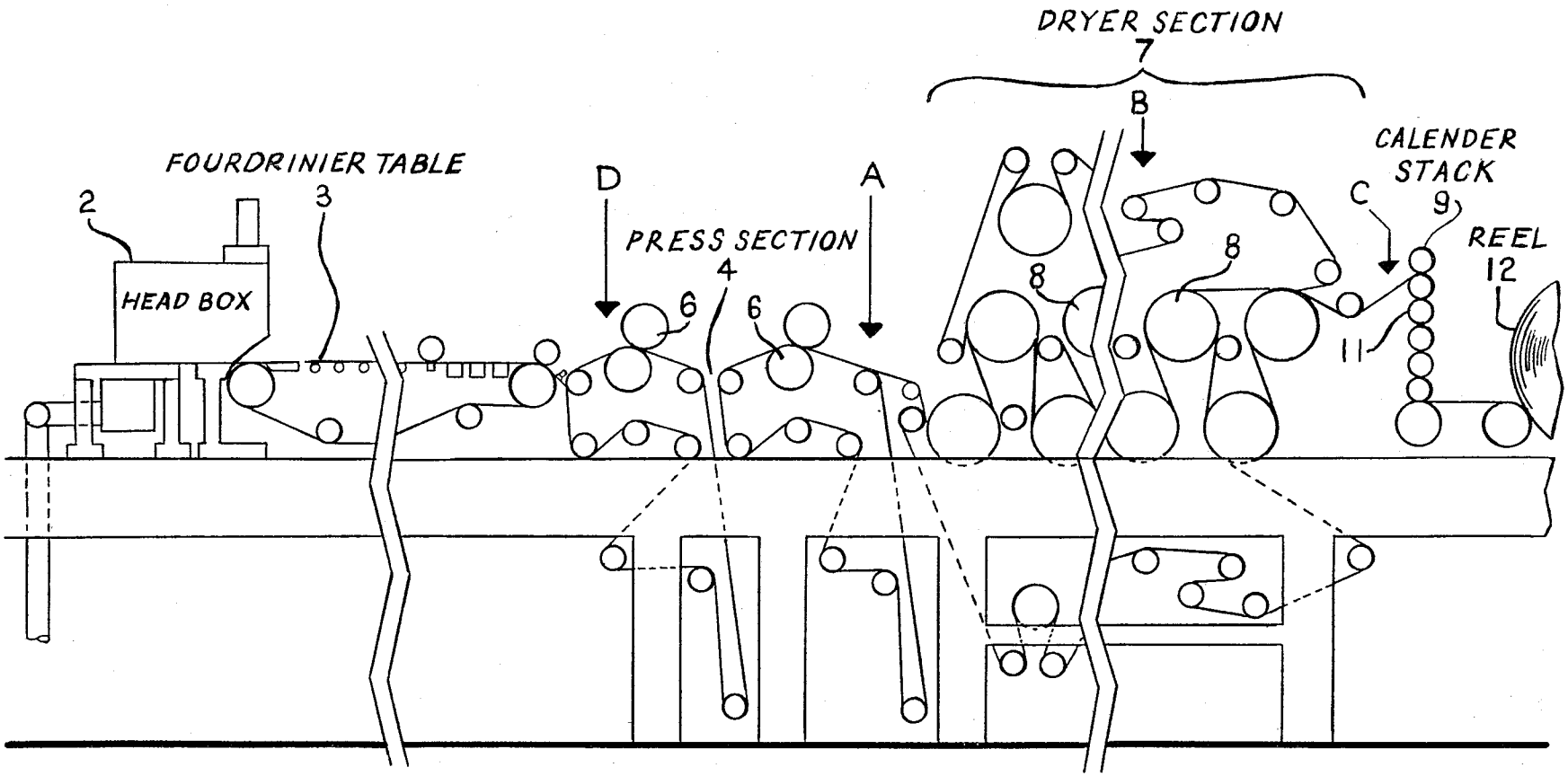

In performing the method hereof, a lignocellulosic mat of for example ground wood fiber is formed in the usual manner as a continuous sheet. After the sheet is formed, it is wetted with a liquid carrier containing an oxidizing agent selected as described below and which penetrates the sheet thoroughly and covers the surfaces of the individual fibers. The wetting may be effected in any suitable manner such as by spraying the liquid carrier containing oxidant over a surface of the sheet or by roller coating the same on such surface. Where a catalyst is employed it is also uniformly dispersed throughout the sheet to promote oxidation by the oxidant. Various procedures of oxidant application to the sheet may be employed, such as:

1. The lignocellulosic fiber sheet may be simply wetted with a liquid carrier containing an oxidant of the type effective without a catalyst discussed hereinafter, or with a mixture of oxidant and catalyst, followed by application of heat and pressure. The effectiveness varies depending upon factors such as type of oxidant, temperature and time. Hydrogen peroxide used with a catalyst, such as a transition metal compound, e.g. zirconium tetrachloride, ferric chloride or cupric chloride can be effectively employed in this manner of application.

2. In many instances a higher level of interfiber bonding may be obtained if the lignocellulosic sheet is first wetted with the oxidant thoroughly penetrating the sheet followed by treatment with a liquid carrier containing a catalyst. Subsequent wetting with a liquid carrier containing hydrogen peroxide forms a Fenton reagent with the transition metal catalyst, which is a very effective oxidizing agent for the lignocellulosic fibers. Pressing under an elevated temperature is then effected.

3. Another mode of application is first to wet the sheet with a liquid carrier containing a peroxide such as a peracid to incorporate peroxy groups into the lignocellulosic material. After such incorporation, a liquid carrier containing a transition metal catalyst is added to the material, followed by application of pressure at an elevated temperature to form the flexible paper sheet.

4. In some commercial processes which are known as dry or semi-dry processes used in the production of fiberboards or hardboards, the dry or semi-dry pulp is formed as a relatively thick mat which may be 2 or 3 inches in thickness, and then compacted into a relatively thin rigid board. Because of the initial thickness of such mat, it may be difficult to obtain uniform penetration or dispersion throughout the mat by spraying or roller spreading the carrier containing the desired oxidizing agent on the mat surface.

To insure such uniform penetration the oxidizing agent, if used alone, and the catalyst if employed with the oxidant have to be thoroughly intermixed with fiber. If the catalyst does not react with the oxidant at ambient temperature, they may be both included in the same liquid carrier. However some catalysts may react with the oxidant at ambient temperature, such as hydrogen peroxide and ferrous sulfate. In such event to produce the reaction initially in the fiber, the catalyst and the oxidant are applied separately in two steps. For example, the carrier and oxidant may be applied first, and then the carrier and catalyst, or vice versa. Also, an oxidizing agent may be mixed with one-half of the material for formation of the mat, and a transition metal catalyst thoroughly mixed with the other half, followed by mixing of the two parts together which results in uniform incorporation of oxidant and catalyst in the mat. The mat is then compacted under pressure and heat to form the desired product.

From the preceding it is seen that particular procedures for performing the method hereof may vary widely. In the manufacture of flexible paper and related products such as flexible liner board, the method hereof can be performed readily on a conventional paper making machine. It is only necessary to spray or otherwise apply to the fiber sheets in the machine a liquid carrier containing oxidant, catalyst, or oxidant and catalyst as the case may be, in the manner outlined above. The liquid carrier penetrates the sheet thoroughly. Also, the agents might be included in the water slurry prior to dehydration of the sheet on the paper making machine.

There are a number of types of oxidizing agents (and of catalysts where they are used) that may be employed as will be listed subsequently. It is only necessary, irrespective of the system of oxidant or of catalyst used, to effect the oxidative bonding reaction among the fibers of the lignocellulosic material at an elevated temperature and for a time sufficient to effect such interfiber bonding. The oxidative reaction is effected primarily by heat but it is desirably conducted under pressure as well as heat in order to effect bonding between fibers, which are kept in close contact by the pressure such as by plates in a conventional press or by the pressure effected by calendar rolls in a paper making machine. In this connection, relatively dry paper already formed may be wetted in the manner related with oxidant or oxidant and catalyst, and when heated increased oxidative bonding will occur.

The temperature and time for obtaining the oxidative bonding reaction among the fibers will vary depending upon the oxidants and the character of the fibrous material. As usual, the lower the temperature the longer the reacting time and vice versa. The reacting temperature should not exceed the temperature at which charring of the lignocellulosic material will occur. Also, the pressure applied should not exceed that at which the lignocellulosic material is crushed.

With higher amounts of some oxidants such as hydrogen peroxide, and compatible catalysts the pressing or reacting temperature may be as low as ambient. A suitable temperature range is between 20° C. and 250° C. with a reaction time of 0.1 to 15.0 minutes at a pressure of between atmospheric and 950 psi.

As a solvent or liquid carrier for the oxidant, any liquid may be employed which does not react with the wood such as water or alcohol. The solvent readily escapes as vapor during the pressing and drying of the mat.

The amount and concentration of oxidant solution will also vary widely depending upon the chemical character of the oxidant, the type of lignocellulosic material, and reaction conditions. In general, an amount of carrier solution (which need not be a true solution but which may be a suspension) is used which will provide from 0.5 to 6.0% of oxidant based on the dry weight of the lignocellulosic material but this range is not critical as even small amounts of reagent are effective. Large amounts serve no useful purpose. For any given oxidant one can readily determine the amounts and conditions of treatment which will produce optimum oxidative bonding.

As noted above, a variety of oxidants may be used for the purposes of this invention to effect the interfiber bonding of defiberized lignocellulosic material by oxidative bonding. Some of these oxidants are effective alone without catalysts while others require or benefit by a catalyst in conjunction therewith to promote the oxidative bonding.

The oxidants that are used are per compounds, nitrates and chlorates, examples of which are as follows:

Per compounds: Hydrogen peroxide, per acids such as peracetic acid, persulfuric acid, ozonides, acylperoxides, such as benzoylperoxide, di- and monoalkylperoxides, such as ethylperoxide, and other compounds with O-O linkage.

Nitrates: Sodium nitrate, ammonium nitrate, potassium nitrate, barium nitrate, lead nitrate, zinc nitrate.

Chlorates: Sodium chlorate, ammonium chlorate, potassium chlorate, barium chlorate.

Where a per compound is used, it is used at an acid pH, e.g. pH=3 to 6 and it is preferably, although not necessarily used with a catalyst. Such catalysts as transition metal compounds, e.g. zirconium tetrachloride, ferric chloride and cupric chloride may be used, also ferrous, manganese, chromium, lead, copper and cobalt salts. Nitrates and chlorates generally require no catalyst and may be used at acid, neutral or alkaline pH.

Catalysts can be applied in the liquid carrier mixed with the oxidant or separately. Catalysts also include various organic and inorganic reducing agents such as hydroquinone, pyrogallol, tannins, hydrazine and bisulfites. The amount of catalyst used is relatively small compared to the amount of oxidant and usually will vary from 0.01% to 1.0% by weight of the oxidant, but this rrange is not critical.

The following are typical examples of hand prepared samples prepared by conventional laboratory procedures demonstrating the principles of the instant invention:

EXAMPLE 1

A mat of Western hemlock ground wood fibers about 1 foot square, was formed on a sieve screen of about 120 mesh from a water slurry of about 4% consistency. It was pressed between such screen and another similar sieve screen to a thickness of about 0.1 in., to partially dehydrate the resultant mat to a consistency of about 40%, and the mat while still wet was then sprayed with a water carrier containing about 15% by weight of hyrogen peroxide and about 0.75% by weight of zirconium tetrachloride; the total amount of carrier, oxidant and catalyst being about 6.5% by weight of the dry weight of fibers. After allowing the carrier and its contents to penetrate the mat which took about 1 minute, the mat was promptly pressed between two 120 mesh sieve screens at a temperature of about 150° C. and pressure of about 700 lbs. per sq. inch (psi) for about 2 minutes to thus form a flexible paper sheet suitable for use as liner board. The physical properties of this sheet and those of following Examples 2 and 3 are noted in subsequent Table I which also includes properties of control samples which were made in the same way as in the examples but without oxidant and catalyst.

In this example, it will be noted that the oxidants and the catalyst were both applied from the same water carrier.

EXAMPLE 2

A mat of one foot square was formed of Western hemlock ground wood fiber from a water slurry containing about 5% by weight of the ground wood and 0.125% of sodium hypochlorite as a preoxidant thoroughly dispersed in the wood fiber. It was pressed as in Example 1 to partially dehydrate the resultant mat to a consistency of about 40%, and was then sprayed with a 2.5% water solution of ferrous sulfate catalyst in the amount of about 5% solution to the weight of dry fibers. After the solution was allowed to penetrate the mat as in Example 1, it was sprayed with a 20% water solution of hydrogen peroxide in the amount of about 5% of solution to the weight of dry fiber, and was then pressed between two sieve screens as in Example 1 at a temperature of about 150° C. and pressure of 700 psi for two minutes which resulted in a flexible paper sheet.

In this example, the impregnation with hypochlorite as a preoxidant, is followed by sequential catalyst and oxidant addition.

EXAMPLE 3

A mat one foot square was formed as in Example 1 from a water slurry of Western ground wood fiber. After draining and partial dehydrating by pressing between two sieve screens, the mat was sprayed with 7.5% water solution of persulfuric acid in the amount of 10% of the solution to the weight of dry fiber. After allowing the penetration to occur (about 2 minutes) the sheet was sprayed with 2.5% water solution of ferrous sulfate in the amount of 10% solution to the weight of dry fiber, and was pressed as in Examples 1 and 2 at a temperature at about 150° C. and pressure of 700 psi for about two minutes. This example illustrates sequential addition of oxidant and catalyst.

The physical properties of the paper sheet materials produced under conditions of Examples 1 through 3 are noted in the following Table I, which as noted above also includes the properties of control samples which were treated in the same way as in Examples 1 through 3 but without the oxidizing agents.

TABLE I

| Example | Thickness in. | Density gr/ft$^2$ | Tensile strength psi dry | Tensile strength psi 24 hrs. soaked | Thickness swelling % |
|---|---|---|---|---|---|
| 1 | 0.023 | 55 | 1987 | 512 | 39 |
| 2 | 0.025 | 54 | 2649 | 663 | 34 |
| 3 | 0.024 | 56 | 2505 | 495 | 26 |
| Control | 0.024 | 57 | 2037 | 282 | 51 |

The data set forth in the Table for each example is an average of 10 tests. From the Table, it will be noted that the thickness and density resulting from all tests are substantially the same. The dry tensile strength data of Examples 2 and 3 evidence the efficaciousness of the oxidative interfiber bonding achieved under the conditions described in these examples.

It is noteworthy that the tensile strengths of the sheets after they had been soaked in water for 24 hours establish the marked improvement in wet strength of Examples 1 through 3 compared to the control. Also, it will be observed that the control had a much higher percent of thickness swelling than the sheets of Examples 1 through 3, which evidences the bonding strength obtained by the method of this invention. The less the swelling, the higher the bonding strength, or decrease in hygroscopicity.

EXAMPLE 4

A rigid hard board suitable as a building board panel was produced in the following manner. Western hemlock ground wood fibers were sprayed with a 1.25% water solution of sodium hypochlorite followed by spraying with a 1.25% water solution of ferrous sulfate both in the amount of about 100% solution to the weight of dry fibers. After thorough mixing, a mat was formed from a water slurry containing about 5% by weight of treated fibers. After draining and partial dehydration by pressing the sheet between two sieve screens as in the previous examples, the sheet was sprayed with a 20% water solution of hydrogen peroxide in the amount of 10% to dry weight of fibers. After such treatment, the sheet was pressed between two sieve screens at a temperature of 150° C. and pressure of about 850 psi for five minutes to produce hardboard of 0.117 in thickness and 1.055 specific gravity. Table II, below, depicts the physical data obtained by an average of ten tests on samples produced by Example 4, compared to a control which was not treated with oxidizing agents, also an average of 10 tests.

TABLE II

| Example | Thickness in. | Specific gravity | Tensile strength psi dry | Tensile strength psi 24 hrs. soaked | Thickness swelling % |
|---|---|---|---|---|---|
| 4 | 0.117 | 1.055 | 4322 | 1424 | 26.6 |
| Control | 0.123 | 1.034 | 4103 | 667 | 52.2 |

EXAMPLE 5

This example is one wherein hard board is produced from a relatively thick mat which is compacted to a relatively thin rigid board. One part of ground wood fiber particles was sprayed with a 1.25% water solution of sodium hypochlorite as a preoxidizing agent followed by spraying with a 1.25% water solution of ferrous sulfate both in the amount of about 10% by weight of the fiber on a dry basis. The other part was sprayed with a 20% water solution of hydrogen peroxide also in the amount of 10% by weight of the dry weight of fibers. The thoroughly wet sprayed parts were then thoroughly mixed together; and a sheet of about a thickness of about 2 inches was formed and then pressed between sieve screens of about 120 mesh to dehydrate the mat to a water consistency of about 40%. The mat was conveyed on the screens into a press in the usual manner, and the mat was compressed to a thickness of about ⅛ inch under a temperature of about 150° C. and pressure of about 850 psi for about 2 minutes which resulted in a rigid hard board suitable for building purposes.

Thickness of the board was 0.120 in.; specific gravity 1.071; dry tensile strength 4,416 psi; tensile strength after 24 hrs. soaking in water 1,519 psi, and thickness swelling 24.4%.

EXAMPLE 6

Fiber made by pressure refining of hardwood chips was sprayed by a water solution of pH 7.5 containing 20% by weight of potassium nitrate. Ten percent of the solution by weight to oven dry fiber was sprayed during substantial mixing of the fiber to get a good distribution of the solution in fiber. After drying the fiber to about 6 to 9% moisture content a fiber mat was formed by hand which was then deposited between two smooth metalic plates into a press and pressed to ¼ inch thick hardboard at 240° C. for 3 minutes at 500 psi pressure. This produced hardboard which had a modulus of rupture of 5,100 psi, an internal bond of 220 psi and a specific gravity of 1.015.

EXAMPLE 7

Fiber made by pressure refining of hardwood chips was sprayed by water solution of 9.0 pH containing 5% of sodium nitrate and 30% of sodium carbonate. Twenty percent of the solution by weight to oven dry wood was sprayed followed by drying the fiber to 6–9% moisture content and forming a fiber mat which was then deposited between two metallic plates in a press and pressed to hardboard. Press platens were at 240° C. and the hardboard was pressed for 3 minutes at 500 psi pressure. The boards had a specific gravity of 0.967, a modulus of rupture of 5,200 psi and an internal bond of 196 psi.

EXAMPLE 8

Fiber made by pressure refining of hardwood chips was sprayed by a water solution containing 11% by weight of sodium chlorate. Eighteen percent of this solution by weight to oven dry fiber was sprayed during substantial mixing of the fiber to get a good distribution of the solution in the fiber which was then formed into a mat. Such mats having about 17% moisture were then deposited between two metallic plates in a press and pressed at 240° C. press platen temperature and 500–180 psi pressure to ¼ inch thick boards for 3 minutes. The resulting boards had a specific gravity of 0.999, a modulus of rupture of 4,900 psi, an internal bond of 350 psi and a thickness swelling after 1 hour in boiling water of 32%.

EXAMPLE 9

Fiber made by pressure refining of hardwood chips was sprayed by a water solution containing 8.42% of sodium chlorate, 20% of sodium carbonate (soda ash), all by weight. Twenty-four percent based on dry fiber of this solution was sprayed during substantial mixing of the fiber to get a good distribution of the solution in the fiber. Fiber mats were hand formed from such fiber having about 17% of moisture which were then deposited in a press between two metallic plates. Press platens were at 240° C. temperature and hardboards were pressed for about 3 minutes at 500–180 psi pressure. This produced ¼ inch thick hardboards having a modulus of rupture of 7,000 psi, an internal bond of about 500 psi and a thickness swelling after 1 hour in boiling water of 33%. Specific gravity was 1.02.

As was noted above, the method hereof is particularly adapted for performance in a paper making machine. Referring to FIG. 1, a conventional type of Fourdrinier machine is schematically illustrated. It comprises headbox 2 from which a slurry of defiberized material, such as ground wood, is discharged onto a Fourdrinier wire or table 3 on which the mat is initially formed. From wire 3, the wet web of paper is continuously discharged into press section 4 through which it is continuously conveyed through press rolls 6, and wherein the moisture content is reduced by mechanical pressure effected by the rolls. The thus partially dehydrated sheet is continuously conveyed through dryer section 7 which removes remaining moisture from the sheet by means of heat and vapor transfer; the dryer section comprising a large number of heated drying rolls 8. From the dryer section, the now substantially dehydrated sheet passes through calender stack 9 comprising a series of smooth surfaced, heated calender rolls 11 which control the thickness of the sheet, its smoothness and other characteristics. The calendered sheet is then wound into a roll 12.

As previously related, the oxidant or oxidant and catalyst may be applied to the defibered lignocellulosic material in various ways rendering the method hereof very versatile. For example, with reference to paper making machine application, if only an oxidant or oxidant and catalyst is applied, the liquid carrier containing the oxidant or mixture of oxidant and catalyst may be suitably added at positions indicated at A, B or C in the machine, which results in penetration of the oxidant, or catalyst and oxidant, into the sheet.

Where mild preoxidation of the sheet is desirable, a small amount of the preoxidizing agent, such as sodium hypochlorite, may be added in the slurry in the headbox, or at position A. The carrier containing the transition metal catalyst may be added midway in the dryer section indicated at position B, and the carrier containing hydrogen peroxide oxidant at position C just ahead of calender stack or rolls.

Where the sheet is to be treated with a peracid or peroxide, it may be added at position D, just before the press section; and the carrier containing a transition metal catalyst at position B or C. Both surfaces or only one surface of the sheet may be wetted. Also, a catalyst solution may be applied to one surface and the oxidant solution to the other surface of the sheet as long as they are thoroughly intermixed in the mat.

From the preceding, it is seen that the procedure comprises a two step process, namely (a) treatment of the defibered lignocellulosic material with oxidant or oxidant and catalyst before pressing, namely before bringing the fiber surfaces into sufficient contact, and (b) effecting the bond formation reaction by temperature increase, and desirably under pressure.

We claim:

1. The method of increasing interfiber bonding among fibers of defiberized lignocellulosic material containing a substantial proportion of the natural lignin content which comprises dispersing substantially throughout a sheet of such material a nitrate and applying heat and pressure to said sheet for a time and temperature sufficient to effect said bonding by oxidative bonding reaction.

2. The method of claim 1 wherein the nitrate is sodium nitrate.

3. The method of increasing interfiber bonding among fibers of defiberized lignocellulosic material containing a substantial proportion of the natural lignin content which comprises dispersing substantially throughout a sheet of such material a chlorate and applying heat and pressure to said sheet for a time and temperature sufficient to effect said bonding by oxidative bonding reaction.

4. The method of claim 3 wherein the chlorate is sodium chlorate.

* * * * *